US005142796A

United States Patent [19]

Anzai et al.

[11] Patent Number: 5,142,796

[45] Date of Patent: Sep. 1, 1992

[54] FLAMERESISTING APPARATUS

[75] Inventors: Hisao Anzai; Nobuyuki Yamamoto; Youichi Kodama; Yoshitaka Imai; Tsutomu Daiguuji, all of Otake, Japan

[73] Assignee: Mitsubishi Rayon Co., Ltd., Tokyo, Japan

[21] Appl. No.: 598,638

[22] PCT Filed: Feb. 21, 1990

[86] PCT No.: PCT/JP90/00204

§ 371 Date: Oct. 23, 1990

§ 102(e) Date: Oct. 23, 1990

[87] PCT Pub. No.: WO90/10101

PCT Pub. Date: Sep. 7, 1990

[30] Foreign Application Priority Data

Feb. 23, 1989 [JP] Japan ..... 1-41695

[51] Int. Cl.[5] ..... F26B 19/00

[52] U.S. Cl. ..... 34/62; 68/2; 34/157; 34/159

[58] Field of Search ..... 34/155, 156, 113, 114, 34/115, 62, 157, 159; 68/2

[56] References Cited

U.S. PATENT DOCUMENTS 4,065,549 12/1977 Kinoshita ..... 423/447.4

FOREIGN PATENT DOCUMENTS 0100411 2/1984 European Pat. Off. .
0111416 6/1984 European Pat. Off. .
2026019 2/1971 Fed. Rep. of Germany .
51-9410 3/1976 Japan .
57-21528 2/1982 Japan .
58-163729 9/1983 Japan .
60-246821 12/1985 Japan .
61-289133 12/1986 Japan .

*Primary Examiner*—Henry A. Bennet
*Attorney, Agent, or Firm*—Oblon, Spivak, McClelland, Maier & Neustadt

[57] ABSTRACT

A flameresisting apparatus in which two sections, referred to as roller compartments, enclosing a series of rollers provided face to face with one another for transferring precursor fiber, are separated from a heat treatment section by two walls facing each other. The walls include apertures for passage of the precursor fiber. Significantly, the two walls facing each other are provided at a distance which enables the precursor fiber to pass from one wall to the other in 5 to 60 seconds. The surface temperature of the rollers and the temperature of the roller compartments are maintained at a temperature of 10° to 80° C. lower than the temperature of the heat treatment compartment, but not lower than 180° C. In addition, heated air is blown against the precursor fiber into the heat treatment compartment. As a result, a flameresisting apparatus is provided which makes it possible to manufacture precursor fiber for carbon fiber at high speed in a short period of time without fusion of the fibers or other uncontrollable reactions.

7 Claims, 1 Drawing Sheet

FLAMERESISTING APPARATUS

TECHNICAL FIELD

The present invention relates to an apparatus for flameresisting precursor fiber before production of carbon fiber.

BACKGROUND ART

Carbon fiber is light and excellent in strength and modulus of elasticity and hence is widely used in sporting goods and leisure goods. In recent years, it has been more improved in performance characteristics and has begun to be used as a primary structural material for spaceships, airplanes, etc. It, however, is more expensive than conventional metal materials and the like as before, and therefore its spread to the fields of general industries and the manufacturing industry is slow and its application are limited to special purposes.

The basic reason of the expensiveness of carbon fiber is its low productivity, in particular, inefficient flameresisting treatment of precursor fiber for carbon fiber (hereinafter referred to as precursor fiber or merely as fiber). The flameresisting treatment of precursor fiber is an exothermic oxidation reaction and is accompanied by generation of a large quantity of heat. Therefore, when a rapid flameresisting treatment is carried out, a vigorous incontrollable reaction is induced by heat accumulation, so that the fiber is melted and cut and that a fire is caused in an extreme case. In order to avoid such a vigorous incontrollable reaction, flameresisting treatment is carried out usually over a period of at least about 1 hour to as long as several hours. This is a cause of a marked lowering of the productivity.

For reducing the flameresisting treatment time, Jap. Pat. Appln. Kokoku (Post-Exam. Publn.) No. 53-21396 (U.S. Pat. No. 4,065,549) has disclosed a process in which precursor fiber is brought into contact with the surface of a heater intermittently and repeatedly. However, when this process is employed, the precursor fibers tend to be fused together with one another and carbonization of the resulting flameresistant fiber cannot yield carbon fiber of practical use.

Further, Jap. Pat. Appln. Kokai (Laid-Open) No. 58-214525 (EP 100411) has disclosed a process in which precursor fiber is treated in a heated oxidative atmosphere while being brought into contact with cooling rollers intermittently. However, when this process is employed, the fiber on the rollers is not rapidly cooled because the temperature around the rollers is high. Moreover, depending on conditions, the fibers tend to be fused together with one another and a stable treatment is impossible because the residence time of the fiber in a heat treatment compartment is not limited to 60 seconds or less, unlike in the present invention.

Still further, Jap. Pat. Appln. Kokoku (Post-Exam. Publn.) No. 51-9410 has disclosed a process in which a zone where fiber is heat-treated and a zone where rollers are accommodated are isolated from each other and the fiber is treated while keeping the temperature of the rollers and the temperature of an atmosphere in the zone where rollers are accommodated lower than the temperature of the zone where fiber is heat-treated. However, also in this process, the residence time in a heat treatment compartment is not limited to 60 seconds or less, unlike in the present invention. Therefore, a stable treatment is impossible depending on conditions, and the fiber is cooled too much, resulting in delay of its reaction in the next heat treatment compartment, because the temperature of the rollers and the temperature of the zone where rollers are accommodated are kept lower than 180° C. Consequently, reduction of the flameresisting treatment time becomes difficult in some cases.

In addition, DOS2026019 has disclosed a process in which fiber is treated by providing rollers outside a furnace in order that the temperature of the rollers is lower than the fusing temperature of the fiber. This process, however, has the same defect as described above because the residence time in a heat treatment compartment is similarly not limited to 60 seconds or less, unlike in the present invention.

DISCLOSURE OF THE INVENTION

An object of the present invention is to improve the above-mentioned conventional flameresisting processes which are not efficient and poor in productivity, and provide an effective flameresisting apparatus which works at high speed and is excellent in productivity.

The present invention relates to, in a flameresisting apparatus wherein two sections (roller compartments) enclosing a series of rollers provided face to face with one another for transferring precursor fiber are separated from a heat treatment section (a heat treatment compartment) by two walls facing each other and having apertures for passage of the precursor fiber, the improvement comprising 1) keeping the two walls facing each other at such a distance from each other as enables the precursor fiber to pass from one of them to the other in 5 to 60 l seconds,

2) having a means for maintaining the surface temperature of the rollers and the temperature of the roller compartments at a temperature 10° C. to 80° C. lower than the temperature of the heat treatment compartment and not lower than 180° C., and 3) having a means for blowing heated air against the precursor fiber into the heat treatment compartment.

According to the present invention, there is provided an excellent flameresisting apparatus which makes it possible to make precursor fiber flameresistant at high speed in a short time without the fusion of fibers together with one another or the vigorous incontrollable reaction. This apparatus permits a lowcost production of carbon fiber having a tensile strength of 300 kg/mm$^2$ or more and a modulus of elasticity of 22 ton/mm$^2$ or more, or having a tensile strength of 360 kg/mm$^2$ or more and a modulus of elasticity of 23 ton/mm$^2$ or more.

BEST MODE FOR CARRYING OUT THE INVENTION

As precursor fiber for carbon fiber, there are generally used organic polymer fibers such as polyacrylonitrile, cellulose, pitch, lignin, etc. Of these, polyacrylonitrile is particularly preferable for obtaining carbon fiber having excellent performance characteristics. The above precursor fibers are made flameresistant at a temperature of 200° to 300° C. in heated air for making the same infusible, before carbonization.

One example of the flameresisting apparatus of the present invention is explained below in detail with reference to FIG. 1 and FIG. 2. FIG. 2 is a view of the apparatus shown in FIG. 1, from the direction of an outlet for fiber (direction A) and shows the flow of air in the apparatus.

Figure 1:
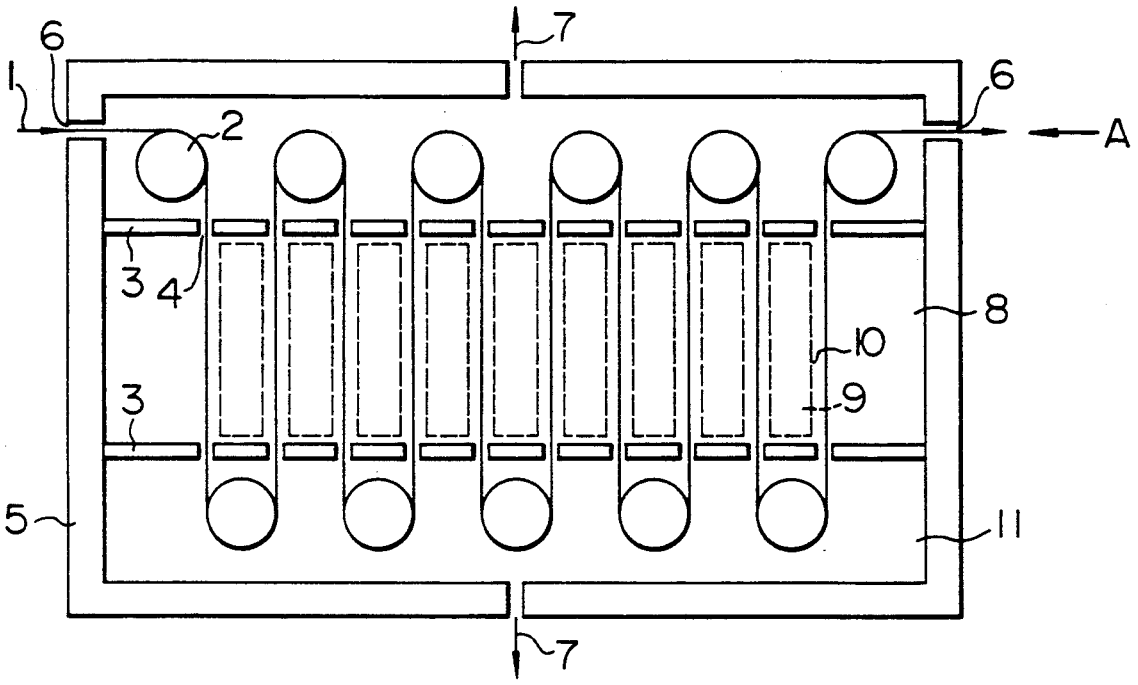
FIG. 1 is a sectional side view of the flameresisting apparatus of the present invention.
Figure 2:
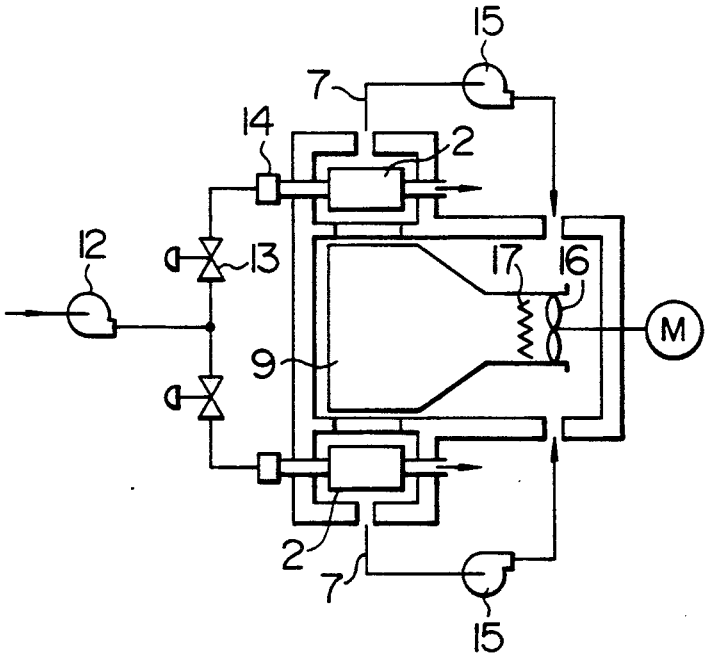
FIG. 2 is a view of said flameresisting apparatus from the direction of an outlet for fiber.

In FIG. 1, precursor fiber 1 is introduced into a flameresisting apparatus surrounded by a heat-insulating material 5, through an opening 6, and transferred in the apparatus by a series of rollers 2. In the apparatus, there are provided walls 3 facing each other and having apertures 4 for passage of the precursor fiber, for separating sections enclosing the series of the rollers (hereinafter referred to as roller compartments) from a heat treatment section (hereinafter referred to as heat treatment compartment).

The walls 3 are provided at a distance from each other at which the precursor fiber to be made flameresistant passes from one of them to the other within a passage time of 5 to 60 seconds. Flameresisting treatment of the precursor fiber for more than 60 seconds tends to cause a vigorous incontrollable reaction, which is liable to be accompanied by melting and cutting of the fiber. The higher the flameresisting treatment temperature, the more remarkable this tendency. When the passage time is shorter than 5 seconds, the temperature of the fiber is lowered before reaching the temperature of the heat treatment compartment, because of a short heating time, resulting in low efficiency and high equipment cost due to need for a large number of rollers. Therefore, the walls 3 are provided at a distance from each other at which the fiber passes from one of them to the other preferably over a period of 10 to 50 seconds.

The fiber subjected to flameresisting treatment in the heat treatment compartment 8 immediately enters the roller compartment 11 whose inside temperature is kept 10° to 80° C. lower than the heat treatment temperature and not lower than 180° C., and it comes into contact with a roller 2 whose surface temperature is kept 10° to 80° C. lower than the heat treatment temperature and not lower than 180° C., to dissipate the heat of reaction accumulated inside the fiber.

When the dissipation of the heat of reaction is not sufficient, the fiber is melted and cut on the surfaces of the rollers 2 in some cases, or fibers, even when not cut, are fused together with one another to make subsequent carbonization treatment impossible in some cases. For avoiding such a trouble, the temperatures of the rollers 2 and the roller compartments 11 should be kept 10° to 80° C., preferably 10° to 70° C., lower than the heat treatment temperature and not lower than 180° C., preferably not lower than 200° C.

In the case where the temperatures of the rollers 2 and the roller compartments 11 are more than 80° C. lower than the heat treatment temperature, or they are lower than 180° C., it becomes difficult to allow flameresisting to proceed sufficiently at the time when the fiber enters the heat treatment compartment 8 again from the roller compartment 11.

As a means for keeping the surface temperature of the rollers 2 10° to 80° C. lower than the heat treatment temperature, circulation of a liquid heat medium through the rollers is thought of but has defects, for example, complicated structure, high cost, and difficulty in rapid control. Therefore, as a preferable means, there is a method which comprises introducing, as shown in FIG. 2, cooling air into the rollers from one end of the axis of each roller by the use of a fan 12, a valve 13 and a rotary joint 14 and discharging the same from the other end, or comprises discharging air introduced into the rollers from one end or both ends of the axis of each roller through apertures formed in the surfaces of the rollers. The cooling air discharged goes out of the roller compartment 11 through an exhaust line 7. As the cooling air, the outside air is usually used.

As a means for keeping the atmosphere temperature of the roller compartments 11 10° to 80° C. lower than the heat treatment temperature, there is usually employed a method in which heated air is introduced into the roller compartments from the heat treatment compartment by means of a fan 15 through the apertures 4 for passage of the fiber while controlling the introducing amount.

The heat treatment compartment 8 has a means for blowing heated air against the fiber. The example shown in FIG. 2 is explained below. Air sent by a fan 16 and heated by a heater 17 is introduced through the inside of duct 9 and blown against the fiber from the inside of duct 9 through the apertures 10. In this case, the heated air should be blown against at least one side of the fiber. This is important not only in heating the fiber cooled to a temperature lower than the heat treatment temperature by the roller 2 and the roller compartment 11 to the heat treatment temperature in a short time, but also in supplying sufficient oxygen to the fiber to be treated, and is effective also in removing a part of the heat of reaction accumulated in the fiber.

In this case, the velocity of the heated air blown against the fiber is 1 to 10 m/sec, preferably 2 to 6 m/sec. When the velocity is lower than this, the following problems are caused. When the treatment is carried out at a relatively low temperature, elevation of the temperature is not rapid, resulting in delay of the reaction. When the treatment is carried out at a high temperature, the heat of reaction cannot be sufficiently removed, resulting in melting and cutting of the fiber, or oxygen necessary for the reaction is not supplied to the fiber, so that the resulting flameresistant fiber is often cut in a subsequent carbonization treatment. When the velocity is higher than this, problems such as frequent breaking of single fibers during the treatment are caused.

The temperature of the heated air blown against the fiber is preferably 230° to 290° C. When the temperature is lower than this, the reaction rate is decreased, so that much time is required for the treatment. When the temperature is higher than this, a decomposition reaction predominates over a flameresisting reaction, so that the resulting flameresistant fiber cannot be suitable for carbonization.

The fiber subjected to the flameresisting treatment is taken out of the apparatus through the opening 6 and further subjected to the flameresisting if necessary or subjected to a carbonization treatment. It is also possible to use this fiber as it is as flameresistant fiber without the carbonization treatment.

The present invention is more concretely explained below with reference to examples. In Examples and Comparative Examples, the tensile strength and the modulus of elasticity were measured in accordance with JIS R7601 method, and the density was measured by the density gradient tube method.

(EXAMPLE 1)

Fifty bundles of polyacryronitrile precursor fibers of 12,000 filaments and 1.2 denier were aligned so as to adjust the distance between the centers of adjacent bundles to 3 mm, and introduced into an equipment composed of the three same flameresisting apparatuses as shown in FIG. 1 which had been connected in series, and flameresisting treatment was carried out. The outside diameter of the rollers 2 was adjusted to 100 mm. The number of the rollers 2 was 11 per each apparatus and the distance between the walls 3 facing each other was 1 m. The fiber was transferred at a speed of 3 m/min and passed between the walls 3 facing each other over a period of 20 seconds for each passage. Seven slit-shaped apertures 10 having a width of 2 mm were formed on each side of the duct 9 for blowing heated air against the fiber, and heated airs at 255° C., 270° C. and 280° C. were blown in the respective apparatuses. In this case, the velocity of the heated airs was adjusted to 4 m/sec. In addition, the temperature of the roller surface was kept 50° C. lower than the temperature inside the heat treatment compartment 8 by introducing cooling air from one axis of each roller and discharging the same outside the system from the other end, and the temperature of the roller compartments was kept 50° C. lower than the temperature inside the heat treatment compartment 8 by controlling the amount of air introduced into the roller compartments 11 through the apertures 4. The total time required for the flameresisting was 10 minutes. The density of the flameresistant fiber after the treatment was 1.35 g/cm$^3$. The flameresistant fiber thus obtained was treated at 600° C. for 1 minute and then at 1400° C. for 1 minute in a nitrogen atmosphere to obtain carbon fiber. Performance characteristics thereof were measured to be satisfactory as follows: tensile strength 360 kg/mm$^2$, modulus of elasticity 23 ton/mm$^2$.

(Comparative Example 1)

When the flameresisting treatment was carried out in the same manner as in Example 1, except for making the temperatures of the rollers and the roller compartments equal to the temperature of the heat treatment compartment by reducing the amount of cooling air introduced into the rollers and increasing the amount of heated air introduced into the roller compartments, fibers were fused together with one another and could not be carbonized.

(Comparative Example 2)

When the flameresisting treatment was carried out in the same manner as in Example 1, except for changing the velocity of heated air blown against the fibers to 0.5 m/sec, the fiber was melted and cut in about 30 minutes and the treatment could not be continued any more.

(Comparative Example 3)

The flameresisting treatment was carried out in the same manner as in Example 1, except for changing the velocity of heated air blown against the fibers to 12 m/sec. The resulting flameresistant fiber showed serious cutting of single yarn, and when it was carbonized under the same conditions as in Example 1, performance characteristics of the resulting carbon fiber were not satisfactory as follows: tensile strength 260 kg/mm$^2$, modulus of elasticity 22 ton/mm$^2$.

(Comparative Example 4)

The flameresisting treatment was carried out in the same manner as in Example 1, except for changing the temperatures of the heated airs blown against the fibers to 255° C., 270° C. and 300° C., respectively. In this case, since the treatment temperatures were high, the total treatment time for the flameresisting was 6 minutes. When the flameresistant fiber thus obtained was carbonized in the same manner as in Example 1, performance characteristics of the resulting carbon fiber were not satisfactory as follows: tensile strength 220 kg/mm$^2$, modulus of elasticity 18 ton/mm$^2$.

(Comparative Example 5)

When the flameresisting treatment was carried out in the same manner as in Example 1, except for changing the transfer speed of the precursor fiber from 3 m/min to 0.5 m/min to pass the precursor fiber between the walls 3 over a period of 2 minutes for each passage, the fiber was melted and cut in about 10 minutes and the treatment could not be continued any more.

(EXAMPLES 2 TO 4)

In Table 1 are tabulated performance characteristics of carbon fibers obtained by carrying out the flameresisting treatment in the same manner as in Example 1, except for employing the conditions shown in Table 1, and carbonizing the treatment product in the same manner as in Example 1. All the carbon fibers were satisfactory. The time required for the fiber to pass between the walls 3 facing each other was varied by varying the transfer speed of the fiber properly.

(EXAMPLE 5)

Three slit-shaped apertures having a width of 1 mm were formed in the surface of each of all the rollers of the apparatus in Example 1. The flameresisting treatment and carbonization treatment were carried out in the same manner as in Example 1, except for using the apparatus thus obtained. Consequently, there was obtained carbon fiber having performance characteristics equivalent to those of the carbon fiber obtained in Example 1, as follows: tensile strength 360 kg/mm$^2$, modulus of elasticity of 23 ton/mm2.

TABLE 1

| | Conditions of flameresisting treatment | | | Performance characteristics of carbon fiber | | |
|---|---|---|---|---|---|---|
| Example | Respective flameresisting treatment temperatures in three flameresisting apparatuses (°C.) | Time required for filaments to pass between walls 3 facing each other (seconds/each passage) | Difference in temperature between heat treatment compartment and roller surface (°C.) | Density (kg/cm$^3$) | Tensile strength (kg/mm$^2$) | Modulus of elasticity in tension (ton/mm$^2$) |
| 2 | 265-275-285 | 16 | 30 | 1.79 | 305 | 22.8 |
| 3 | 260-270-285 | 19 | 20 | 1.80 | 315 | 23.3 |
| 4 | 245-260-280 | 40 | 45 | 1.81 | 346 | 23.8 |

We claim:

1. In a flameresisting apparatus wherein two roller compartments enclosing a series of rollers provided face to face with one another for transferring precursor fiber are separated from a heat treatment section which includes at least one heat treatment compartment by two walls facing each other, said walls having apertures for passage of the precursor fiber, the improvement comprising:

1) the two walls facing each other are provided at such a distance from each other to enable the precursor fiber to pass from one wall to the other in 5 to 6 seconds,
2) said apparatus including means for maintaining the surface temperature of the rollers and the temperature of the roller compartments at a temperature 10° to 80° C. lower than the temperature of the heat treatment compartment and not lower than 180° C., and
3) said apparatus further including means for blowing heated air against the precursor fiber in the heat treatment compartment.

2. A flameresisting apparatus according to claim 1, wherein the means for blowing heated air is a means for blowing air having a temperature of 230° C. to 290° C. at a velocity of 1 to 10 m/sec.

3. A flameresisting apparatus according to claim 1, wherein the means for maintaining the surface temperature of the rollers 10° to 80° C. lower than temperature of the heat treatment compartment includes means for introducing cooling air from one end of an axis of each roller and for discharging the cooling air form the other end of the axis.

4. A flameresisting apparatus according to claim 1, wherein the means for maintaining the surface temperature of the rollers 10° to 80° C. lower than the temperature of the heat treatment compartment includes means or introducing cooling air into each roller from at least one end of an axis of the roller and for discharging the introduced air form apertures formed in the surface of the roller.

5. A flameresisting apparatus according to claim 1, wherein the precursor fiber is polyacrylonitrile fiber.

6. A flameresisting apparatus according to claim 1, wherein the walls facing each other are kept at such a distance from each other to enable the precursor fiber to pass from one of them to the other in 10 to 50 seconds.

7. A flameresisting apparatus according to claim 1, wherein the means for maintaining the surface temperature of the rollers and the temperature of the roller compartments at a temperature 10° to 80° C. lower than the temperature of the heat treatment compartment and not lower than 180° C. is a means for maintaining the surface temperature of the rollers and the temperature of the roller compartments at a temperature 10° to 70° C. lower than the temperature of the heat treatment compartment and not lower than 200° C.

* * * * *